US011134824B2

(12) United States Patent
Jarjour et al.

(10) Patent No.: US 11,134,824 B2
(45) Date of Patent: Oct. 5, 2021

(54) WAREWASH MACHINE WITH RACK TRACK SUPPORT MEMBER

(71) Applicant: ILLINOIS TOOL WORKS INC., Glenview, IL (US)

(72) Inventors: Daniel Jarjour, Troy, OH (US); Steven M. Willhite, Troy, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 93 days.

(21) Appl. No.: 16/544,314

(22) Filed: Aug. 19, 2019

(65) Prior Publication Data

US 2020/0060505 A1 Feb. 27, 2020

Related U.S. Application Data

(60) Provisional application No. 62/720,625, filed on Aug. 21, 2018.

(51) Int. Cl.
*A47L 15/00* (2006.01)

(52) U.S. Cl.
CPC ..... *A47L 15/0081* (2013.01)

(58) Field of Classification Search
CPC ..... A47L 15/0081; A47L 15/24–248; A47L 15/50–508; A47L 15/0076–0081; A47L 15/00–508
See application file for complete search history.

(56) References Cited

U.S. PATENT DOCUMENTS

| | | | | |
|---|---|---|---|---|
| 5,971,513 | A | 10/1999 | Cassalia | |
| 6,247,771 | B1 | 6/2001 | Miller | |
| 6,321,762 | B1 * | 11/2001 | Suyama | A47L 15/0081 134/104.1 |
| 7,021,322 | B2 | 4/2006 | Kramer | |
| 7,350,528 | B2 | 4/2008 | Brunswick | |
| 7,455,066 | B2 | 11/2008 | Feddema | |
| 7,857,146 | B2 | 12/2010 | Disch | |
| 8,679,261 | B2 | 3/2014 | Brunswick | |
| 8,915,560 | B2 | 12/2014 | Cox | |
| 9,763,554 | B2 | 9/2017 | Watson | |

FOREIGN PATENT DOCUMENTS

| | | | | |
|---|---|---|---|---|
| CN | 206630573 | U | 11/2017 | |
| WO | WO-2013109799 | A1 * | 7/2013 | A47L 15/501 |

* cited by examiner

*Primary Examiner* — Spencer E. Bell
(74) *Attorney, Agent, or Firm* — Thompson Hine LLP

(57) ABSTRACT

A warewash machine includes a housing, which at least in part, defines a treatment chamber having an access opening, and a door mounted for movement between a lowered and closed position for washing and a raised and open position for inlet and outlet of wares through the access opening. At least one nozzle is provided for emitting liquid into the treatment chamber. A rack track is positioned within the treatment chamber, the rack track movable between a use orientation and a cleaning orientation within the treatment chamber. A track support is mounted for movement between a use orientation and a storage orientation, wherein, when the track support is in the use orientation, the track support is engageable with a portion of the rack track to maintain the rack track in the cleaning orientation.

13 Claims, 5 Drawing Sheets

WAREWASH MACHINE WITH RACK TRACK SUPPORT MEMBER

TECHNICAL FIELD

This application relates general to machines for washing wares, and more particularly to a warewash machine that includes a rack track.

BACKGROUND

Warewash machines are frequently used by commercial enterprises, such as restaurants and cafeterias, for washing relatively large and high numbers of wares. Often, the wares are placed in a rack for ease of handling and to maintain separation between the wares during washing. With a rack full of wares, the rack can be heavy. Often, warewash machines are located adjacent to separate tables that can temporarily hold racks prior to loading and after unloading from a machine. Some warewash machines have front and side access openings to the treatment chamber so that the wares do not have to be removed from the treatment chamber through the same access opening through which they were placed into the treatment chamber. A rack track is located in the machine to facilitate sliding movement of the ware racks into and out of the machine and to support the rack in the machine during cleaning operations. A sump/tank below the rack track forms part of the wash spray system, in which washing liquid sprayed from one or more wash arms in the machine and the sprayed wash liquid falls down into the sump and is then recirculated back to the spray arm(s) by a pump. Access to the sump/tank is desirable and therefore the rack track may be removable to allow access to the sump to access a scrap basket, wash arm, rinse arm and/or strainer.

It would be desirable to easily facilitate access to the sump without rack track removal and without requiring a user to constantly hold the rack track.

SUMMARY

In one aspect, a warewash machine includes a housing, which at least in part, defines a treatment chamber having an access opening. A door is mounted for movement between a lowered and closed position for washing and a raised and open position for inlet and outlet of wares through the access opening. At least one nozzle is provided for emitting liquid into the treatment chamber. A rack track is positioned within the treatment chamber for having a dish rack rest thereon during washing, the rack track including a substantially horizontal use orientation and being pivotal upward along a pivot axis located toward one side of the rack track into an upwardly angled orientation for access to one or more components below the rack track. A support hook is mounted for movement between a use orientation and a storage orientation, wherein, when the support hook is in the use orientation, the support hook is engageable with a portion of the rack track to support the rack track in the upwardly angled orientation.

In another aspect, a warewash machine includes a housing, which at least in part, defines a treatment chamber having an access opening, and a door mounted for movement between a lowered and closed position for washing and a raised and open position for inlet and outlet of wares through the access opening. At least one nozzle is provided for emitting liquid into the treatment chamber. A rack track is positioned within the treatment chamber, the rack track movable between a use orientation and a cleaning orientation within the treatment chamber. A track support is mounted for movement between a use orientation and a storage orientation, wherein, when the track support is in the use orientation, the track support is engageable with a portion of the rack track to maintain the rack track in the cleaning orientation.

The details of one or more embodiments are set forth in the accompanying drawings and the description below. Other features, objects, and advantages will be apparent from the description and drawings, and from the claims.

DETAILED DESCRIPTION

Figure 1:
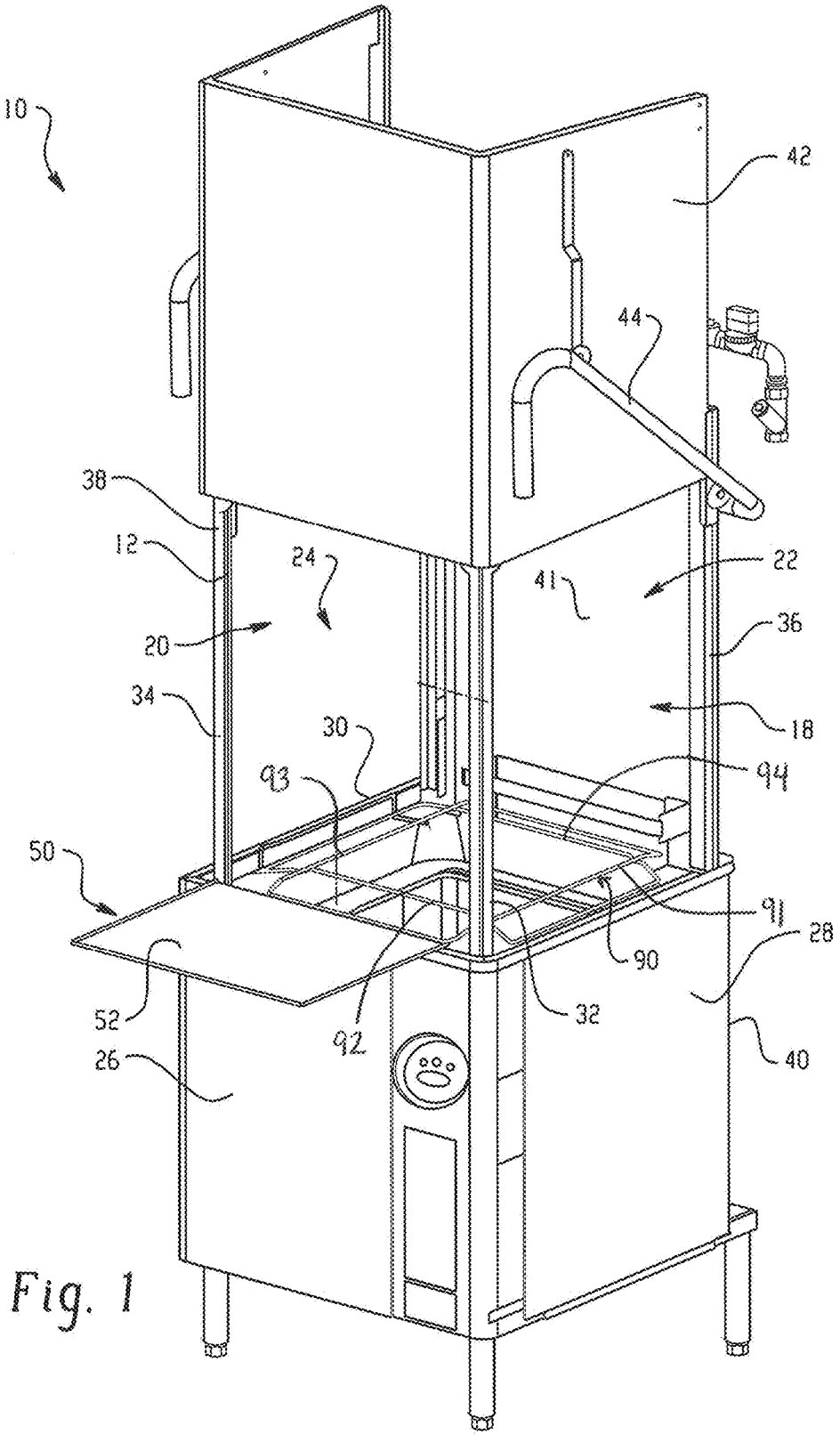
FIG. 1 is a perspective view of a hood-type warewash machine.
Figure 3:
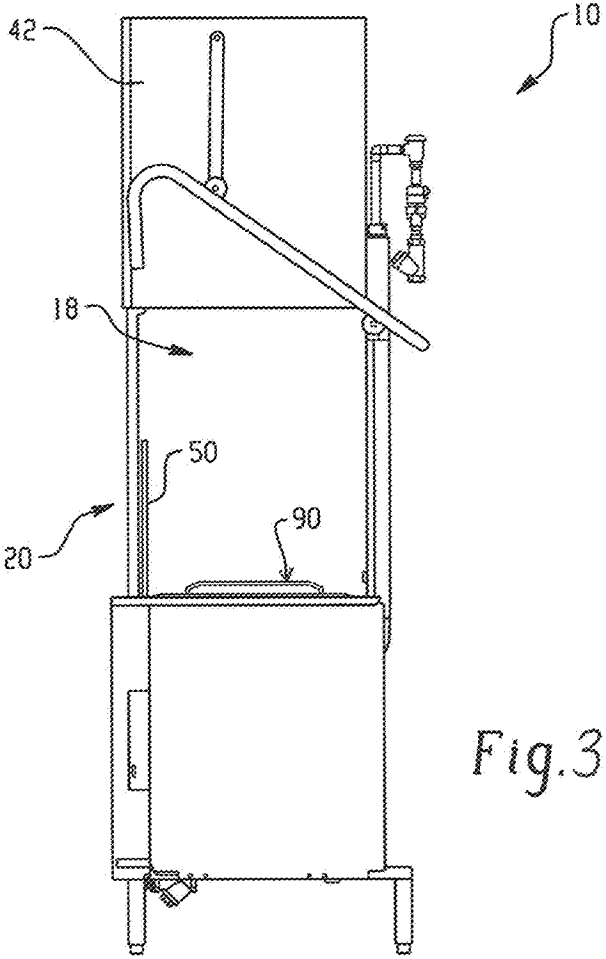
FIG. 3 is a side view of the machine with hood raised.
Figure 2:
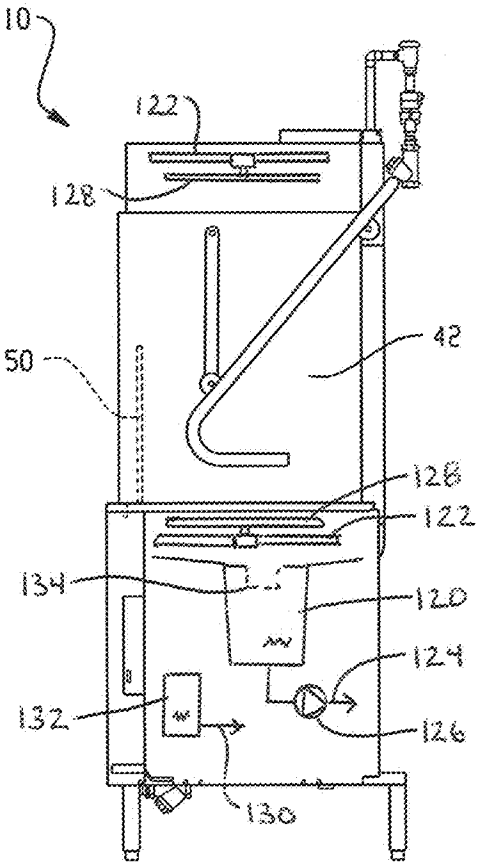
FIG. 2 is a side view of the machine with hood lowered.

Referring to FIGS. 1-3, a warewash machine 10 includes a housing formed by a frame 12 and various panels or similar structure. A treatment chamber 18 is located internally of the housing. For the placement and removal of wares into and out of the treatment chamber 18, a set of access openings 20, 22, 24 are provided. The access openings 20, 22, 24 are disposed at the front 26 and right and left sides 28, 30, respectively, of the warewash machine 10 and, in the illustrated embodiment, are located between frame members 32, 34, 36, 38. At a rear side 40 of the warewash machine 10, a rear housing panel 41 is fixedly attached to the warewash machine, e.g., to inhibit access to the treatment chamber 18 from the rear side 40. To control access to the treatment chamber 18 from the front 26 and sides 28, 30, a three-sided door 42 is provided that can slide or pivot between closed and open positions using arm 44.

Extending outwardly at the front 26 of the warewash machine 10 is a table 50. Table 50 is pivotally mounted to the warewash machine 10 and is shown in a load/unload position (FIG. 1) with a broad, planar upper surface 52 extending outwardly from the front 26 of the warewash machine in a rack supporting orientation in which a rack will be supported vertically above the floor. The table 50 can be pivoted from its load/unload position (e.g., for supporting a rack of wares) to a vertical storage position (e.g., for cleaning the table during a routine ware washing operation), as per FIGS. 2 and 3 that show the hood down and hood up positions of the machine.

The rack track 90 is also shown in FIG. 1. The rack track 90 may be supported within the treatment chamber in a substantially horizontal use orientation by support structure located at both the front and rear of the treatment chamber. By way of example, the support structure may be various internal housing surfaces and/or brackets. The illustrated rack track 90 is of a metal bar or wire form configuration, with upper bar sections 91, 92, 93 and 94 defining a support surface for a rack containing wares to be cleaned (e.g., dishes, glasses, pots and/or pans etc.).

As shown schematically in FIG. 2, the warewash machine includes a wash system including a wash tank 120 and upper and/or lower wash arms 122 with a plurality of spray nozzles oriented to spray onto wares in the treatment chamber. A wash line 124 runs from the wash tank to the wash arm(s), and a wash pump 126 is located along the wash line. Upper and/or lower rinse arms 128 are also provided, to which rinse liquid may be fed via a rinse line 130 running from a booster heater 132 (e.g., under mains pressure or via a rinse pump (not shown)).

During a typical ware cleaning cycle, wash liquid is recirculated by the wash pump 126 and delivered to the wash arms 122 for spraying for a set time period, and then the wash pump 126 is turned off and rinse liquid is delivered to the rinse arms 128 for spraying. The wash tank may typically have an associated filter screen and/or basket 134 to filter out larger food scraps that fall from the wares during ware cleaning. The basket 134 may be removable for cleaning and to provide access to the internals of the wash tank 120 for cleaning and/or maintenance. In order to best access the components below the rack track 90, it is desirable to move the rack track so that it does not block access.

Figure 4:
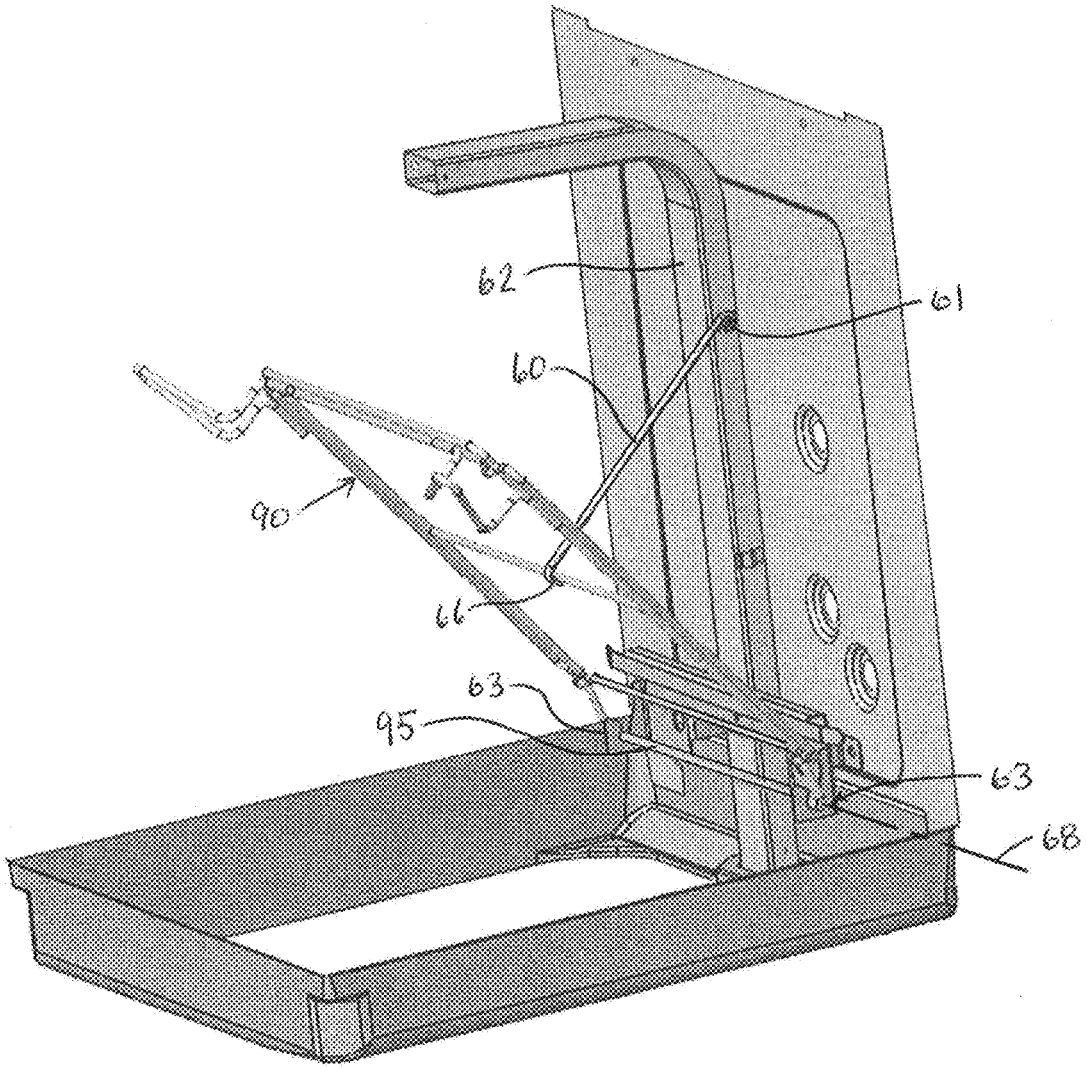
FIGS. 4 and 5 are partial perspective views of a rack track engaged by one embodiment of a lift/support hook.
Figure 5:
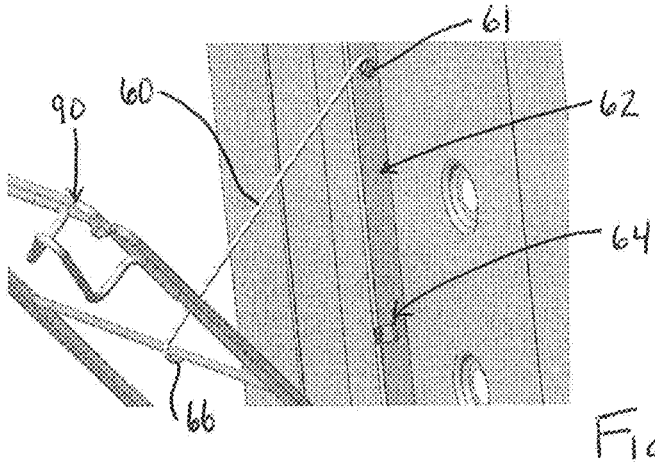
Figure 6:
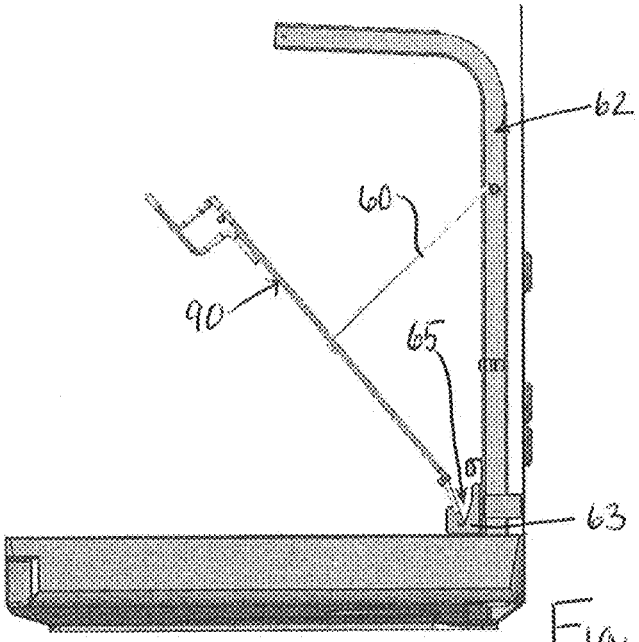
FIG. 6 is a partial side view of the rack track and support hook.

Referring now to FIGS. 4-6, one embodiment of a track support in the form of a rack track lift hook arrangement is shown. The lift hook arrangement is provided toward a rear side of the treatment chamber in order to facilitate retention of the rack track 90 in in a raised position that enables access to the tank 120, filter basket 134 and lower rinse and wash arms. In the illustrated embodiment, a lift hook 60 is pivotally mounted to a pin 61 at the lateral side of an upwardly extending duct housing 62 in which the wash line and rinse line run in order to reach the upper wash arm and rinse arm. However, in other embodiments, the hook 60 could be mounted directly to the chamber rear wall. A hook clip 64 is also provided at the later side of the duct housing to retain the lift hook 60 in a lowered storage position or orientation alongside the duct housing 62 when the lift hook 60 is not being used to support the rack track. As shown, the lift hook pivots forward and includes a distal, free end 66 configured (e.g., with a hook shape) to engage part of the rack track 90 (e.g., a central wire form or bar of the track) when the rack track 90 is pivoted upward about a rear pivot axis 68 formed by the rack support structure. Here, the rack track support structure includes spaced apart brackets 63 located toward the rear side of the treatment chamber, wherein the bracket includes an upwardly facing slot 65 in which a lower rear support rail/rod/bar 95 of the rack track 90 seats, and the pivot axis 68 is defined by a seated position of the rear support rail/rod/bar in the bracket 63.

Figure 7:
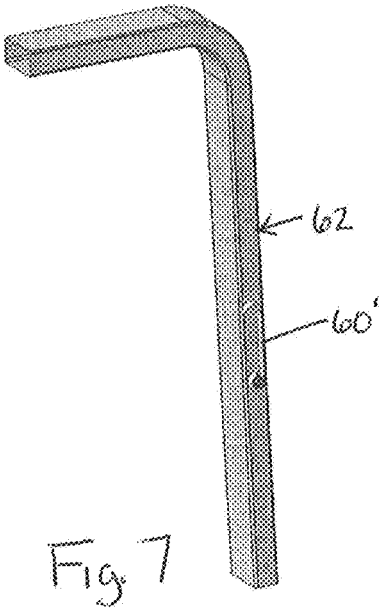
FIGS. 7-9 show partial perspectives of another exemplary support hook and support hook mount configuration.
Figure 8:
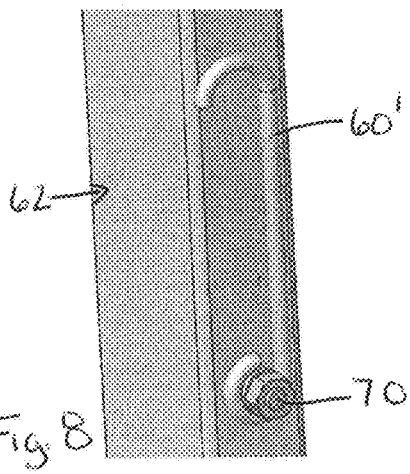
Figure 9:
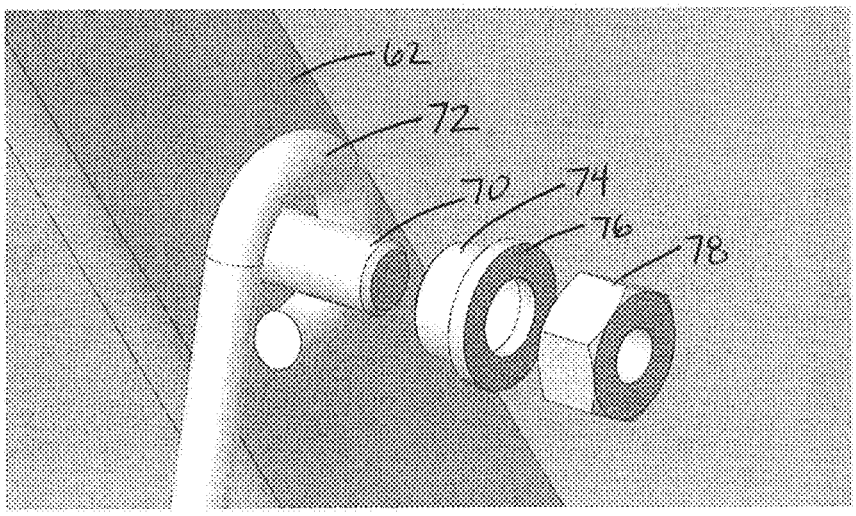

FIGS. 7-9 show another embodiment with a shorter lift hook 60'. Here, a stud or pin 70 is mounted to the side of the duct housing 62 and the mount end 72 of the lift hook 60' is looped to be disposed on the stud or pin. The stud or pin may be threaded, with a stainless steel spacer 74, washer 76 and lock nut 78 securing the mount end 72 on the stud/pin in a manner that enables pivot of the hook. The lift hook 60' could be placed in a substantially vertical orientation, extending either upward or downward along the manifold 62, when the lift hook is not in use. The lift hook 60' extends forwardly and downwardly from the pivot axis defined by the stud or pin 70 in order for the hook end to engage and support the rack track in an upwardly angled orientation (e.g., similar to the orientation shown in FIG. 6).

To access the scrap basket, wash arm, rise arm, and/or strainer, the operator pivots the forward end of rack track upward (into the angled cleaning orientation) and supports the rack track in the raised position using the lift hook. By way of example, the upward pivot of the rack track, when supported by the lift hook, may be at least forty-five degrees, such as fifty degrees or more, but other variations are possible. After cleaning, the scrap basket, wash arm, rise arm, and strainer, the operator releases the rack track from the lift hook, lowers the rack track back down to the horizontal use position, and returns the lift hook to its storage/non-use orientation.

It is to be clearly understood that the above description is intended by way of illustration and example only, is not intended to be taken by way of limitation, and that other changes and modifications are possible. The lift hook is just one example, and other configurations of rack track support members could be used.

What is claimed is:

1. A warewash machine comprising:

a housing at least in part defining a treatment chamber having an access opening;

a door mounted for movement between a closed position for washing and an open position for inlet and outlet of wares through the access opening;

at least one nozzle for emitting liquid into the treatment chamber;

a rack track positioned within the treatment chamber for having a dish rack rest thereon during washing, the rack track including a substantially horizontal use orientation and being pivotal upward about a pivot axis located toward one side of the rack track into an upwardly angled orientation for access to one or more components below the rack track; and a support hook mounted for movement between a use orientation and a storage orientation, wherein, when the support hook is in the use orientation, the support hook is engageable with a portion of the rack track to support the rack track in the upwardly angled orientation, wherein the support hook is mounted above the rack track toward a rear side of the treatment chamber.

2. The warewash machine of claim 1, wherein the support hook is pivotally mounted in the machine.

3. The warewash machine of claim 1, wherein the pivot axis of the rack track is located toward the rear side of the treatment chamber and the support hook is mounted toward the rear side of the treatment chamber.

4. The warewash machine of claim 3, further comprising an upper wash arm in which the nozzle is located, wherein the support hook is mounted to an upwardly extending duct housing in which at least a wash line runs for delivering wash liquid to the upper wash arm.

5. The warewash machine of claim 1, wherein the support hook is pivotally mounted on a pin of the machine.

6. The warewash machine of claim 5, wherein the pin extends from a lateral side of a duct housing in which a wash line of the machine runs, wherein, in the storage orientation, the support hook extends downward along the lateral side of the duct housing, wherein, in the use orientation, the support hook extends forwardly of the duct housing to engage the portion of the rack track.

7. The warewash machine of claim 6, further comprising a clip to releasably retain the support hook in the storage orientation.

8. The warewash machine of claim 7, wherein the clip is mounted on the lateral side of the duct housing.

9. The warewash machine of claim 1, wherein the rack track includes a rear support rail, wherein the housing includes a bracket located toward the rear side of the treatment chamber, wherein the bracket includes a slot in which the rear support rail seats, wherein the pivot axis is defined by a seated position of the rear support rail in the bracket.

10. A warewash machine comprising:

a housing at least in part defining a treatment chamber having an access opening;

a door mounted for movement between a closed position for washing and an open position for inlet and outlet of wares through the access opening;

a wash system including a wash tank, a plurality of spray nozzles, a wash line running from the wash tank to the spray nozzles, and a wash pump located along the wash line, wherein the plurality of spray nozzles are oriented for spraying liquid into the treatment chamber;

a rack track positioned within the treatment chamber above the wash tank, the rack track movable between a use orientation within the treatment chamber and a cleaning orientation within the treatment chamber, in the use orientation a forward end of the rack track is seated on a forward support portion of the housing, in the cleaning orientation the forward end of the rack track is raised upward above the forward support portion to enable access to one or more components below the rack track; and a track support mounted for movement between a use orientation and a storage orientation, wherein, when the track support is in the use orientation, the track support is releasably engageable with a portion of the rack track to maintain the rack track in the cleaning orientation;

wherein the track support is mounted for pivotable movement about a pivot axis, wherein, in the storage orientation, the track support is positioned rearwardly of the rack track, wherein, in the use orientation, a free end of the track support extends forwardly of the pivot axis to engage the portion of the rack track.

11. The warewash machine of claim 10, wherein the pivot axis is located higher than a rack support plane that is defined by the rack track when the rack track is in the use orientation, wherein the track support extends forwardly and downwardly from the pivot axis when in the use orientation.

12. The warewash machine of claim 11, wherein, in the storage orientation, the track support extends substantially vertically upward from the pivot axis or substantially vertically downward from the pivot axis.

13. A warewash machine comprising:

a housing at least in part defining a treatment chamber having an access opening;

a door mounted for movement between a closed position for washing and an open position for inlet and outlet of wares through the access opening;

a wash system including a wash tank, a plurality of spray nozzles, a wash line running from the wash tank to the spray nozzles, and a wash pump located along the wash line, wherein the plurality of spray nozzles are oriented for spraying liquid into the treatment chamber;

a rack track positioned within the treatment chamber above the wash tank, the rack track movable between a use orientation within the treatment chamber and a cleaning orientation within the treatment chamber, in the use orientation a forward end of the rack track is seated on a forward support portion of the housing, in the cleaning orientation the forward end of the rack track is raised upward above the forward support portion to enable access to one or more components below the rack track; and a track support mounted for movement between a use orientation and a storage orientation, wherein, when the track support is in the use orientation, the track support is releasably engageable with a portion of the rack track to maintain the rack track in the cleaning orientation;

wherein the track support is mounted such that, in the use orientation, a free end of the track support extends downwardly to engage the portion of the rack track.

* * * * *